US009728323B2

(12) United States Patent
Weinberg

(10) Patent No.: US 9,728,323 B2
(45) Date of Patent: Aug. 8, 2017

(54) POLYAMIDE ELECTRICAL INSULATION FOR USE IN LIQUID FILLED TRANSFORMERS

(76) Inventor: Martin Weinberg, New Canaan, CT (US)

( * ) Notice: Subject to any disclaimer, the term of this patent is extended or adjusted under 35 U.S.C. 154(b) by 435 days.

(21) Appl. No.: 13/993,761

(22) PCT Filed: Aug. 19, 2011

(86) PCT No.: PCT/US2011/048446

§ 371 (c)(1),
(2), (4) Date: Oct. 9, 2013

(87) PCT Pub. No.: WO2012/024602

PCT Pub. Date: Feb. 23, 2012

(65) Prior Publication Data

US 2014/0022039 A1 Jan. 23, 2014

Related U.S. Application Data

(60) Provisional application No. 61/401,749, filed on Aug. 19, 2010.

(51) Int. Cl.

| | |
|---|---|
| ***H01F 27/10*** | (2006.01) |
| ***H01F 30/12*** | (2006.01) |
| ***H01F 27/32*** | (2006.01) |
| ***H01B 3/10*** | (2006.01) |
| ***H01B 7/28*** | (2006.01) |
| ***H01F 27/12*** | (2006.01) |

(52) U.S. Cl.

CPC ..... *H01F 27/32* (2013.01); *H01B 3/105* (2013.01); *H01B 7/28* (2013.01); *H01F 27/12* (2013.01); *H01F 27/323* (2013.01); *Y10T 428/294* (2015.01); *Y10T 428/2958* (2015.01)

(58) Field of Classification Search

CPC ..... H01F 27/32
USPC ..... 336/5, 58
See application file for complete search history.

(56) References Cited

U.S. PATENT DOCUMENTS

| | | | |
|---|---|---|---|
| 2,130,523 | A | 9/1938 | Carothers |
| 2,278,350 | A | 3/1942 | Graves |
| 2,333,922 | A | 11/1943 | Foster |
| 2,456,717 | A | 12/1948 | Lowden |

(Continued)

FOREIGN PATENT DOCUMENTS

| | | |
|---|---|---|
| WO | 2007114257 | 10/2007 |

OTHER PUBLICATIONS

EP search report for EP11818836.6 dated Jul. 11, 2016.

(Continued)

*Primary Examiner* — Mangtin Lian
*Assistant Examiner* — Ronald Hinson
(74) *Attorney, Agent, or Firm* — O'Shea Getz P.C.

(57) ABSTRACT

A transformer assembly is provided that includes a housing, transformer oil disposed within the housing, a plurality of coils of electrically conductive wire, and aliphatic polyamide insulation material operable to insulate the coils disposed within the oil. The plurality of electrically conductive coils is disposed in the housing and in contact with the transformer oil. The aliphatic polyamide insulation material includes stabilizing compounds and nano-fillers. The stabilizing compounds provide thermal and chemical stability for the insulation material.

17 Claims, 2 Drawing Sheets

(56) References Cited

U.S. PATENT DOCUMENTS

| | | | | |
|---|---|---|---|---|
| 2,705,227 | A | 3/1955 | Stamatoff | |
| 2,991,326 | A | 7/1961 | Ford et al. | |
| 3,503,797 | A * | 3/1970 | Koichi et al. | 427/116 |
| 3,676,814 | A | 7/1972 | Trunzo et al. | |
| 3,841,959 | A | 10/1974 | Mertens | |
| 4,342,814 | A | 8/1982 | Usuki et al. | |
| 4,420,536 | A | 12/1983 | Saunders et al. | |
| 4,616,053 | A | 10/1986 | Schultz et al. | |
| 4,624,718 | A | 11/1986 | Hessler et al. | |
| 5,296,558 | A | 3/1994 | Hood et al. | |
| 5,350,794 | A | 9/1994 | Herron et al. | |
| 5,487,856 | A | 1/1996 | Saraf | |
| 5,750,257 | A | 5/1998 | Doshita et al. | |
| 5,861,071 | A | 1/1999 | McBane | |
| 6,087,591 | A | 7/2000 | Nguyen | |
| 6,231,979 | B1 | 5/2001 | Nagamine et al. | |
| 6,492,892 | B1 | 12/2002 | Brennan et al. | |
| 6,525,272 | B2 | 2/2003 | Higashiura et al. | |
| 8,114,251 | B2 * | 2/2012 | Levit et al. | 162/146 |
| 2002/0046746 | A1 | 4/2002 | Nakabayashi et al. | |
| 2003/0055179 | A1 | 3/2003 | Ota et al. | |
| 2010/0039199 | A1 | 2/2010 | Weinberg et al. | |
| 2010/0101828 | A1 | 4/2010 | Duarte Pena et al. | |
| 2010/0148903 | A1 | 6/2010 | Yin et al. | |
| 2010/0230133 | A1 * | 9/2010 | Saito et al. | 174/120 C |

OTHER PUBLICATIONS

"Extrusion Production Technology of Thermoplastic Plastics", edited by Wang Jialong, 2003, pp. 425-432.

Chinese office action for CN2017041701343420 dated Apr. 20, 2017.

* cited by examiner

POLYAMIDE ELECTRICAL INSULATION FOR USE IN LIQUID FILLED TRANSFORMERS

The present application is entitled to the benefit of and incorporates by reference essential subject matter disclosed in U.S. Provisional Patent Application Ser. No. 61/401,749, filed Aug. 19, 2010.

BACKGROUND OF THE INVENTION

1. Technical Field

This invention relates to electrical components that utilize electrical insulation for use in a liquid environment in general, and to electrical transformers and components thereof that utilize electrical insulation in an oil environment in particular.

2. Background Information

Current standard insulating materials in liquid filled transformers are cellulosic materials of various thicknesses and density. Cellulose-based insulating materials, commonly called Kraft papers, have been widely used in oil-filled electrical distribution equipment since the early 1900's. Despite some of the shortcomings of cellulose, Kraft paper continues to be the insulation of choice in virtually all oil-filled transformers because of its low cost and reasonable performance. It is well known, however, that cellulosic insulation in an oil environment is subject to thermal degradation and vulnerable to oxidative and hydrolytic attack.

Within a transformer, cellulose-based insulating materials are often used in five different ways to insulate internal structure: (1) turn-to-turn insulation of magnet wires; (2) layer-to-layer insulation (e.g., between layers of wires); (3) low-voltage coil-to-ground insulation (e.g., between the low voltage coil and a grounded housing structure); (4) high-voltage coil-to-low voltage coil insulation (e.g., in sheet form between coils); and (5) high-voltage coil-to-ground insulation.

The low-voltage coil-to-ground and the high-to-low voltage coil insulations usually consist of solid tubes combined with liquid filled spaces. The purpose of these spaces is to remove the heat from the core and coil structure through convection of the medium, and also help to improve the insulation strengths. The internal turn insulation is generally placed directly on the rectangular magnet wires and wrapped as paper tape. The material that is chosen to insulate the layer-to-layer, coil-to-coil, and coil-to-ground insulation is according to the insulating requirements. These materials may vary from Kraft paper that is used in smaller transformers, whereas relatively thick spacers made of heavy cellulose press board, cellulose paper or porcelain are used for higher rating transformers. The following are areas of importance describing the current art.

Moisture

The presence of moisture in a transformer deteriorates cellulosic transformer insulation by decreasing both the electrical and mechanical strength. In general, the mechanical life of the insulation is reduced by half for each doubling in water content and the rate of thermal deterioration of the paper is proportional to its water content. The importance of moisture presence in paper and oil systems has been recognized since the 1920's.

The electrical quality of cellulosic material is highly dependent upon its moisture content. For most applications, a maximum initial moisture content of 0.5% is regarded as acceptable. In order to achieve this moisture level the cellulosic material has to be processed under heat and vacuum to remove the moisture before oil impregnation. The complete removal of moisture from cellulosic insulation without causing chemical degradation is a practical impossibility. Determination of the ultimate limit to which cellulose can be safely heated for the purposes of dehydrating without affecting its mechanical and electrical properties continues to be a major problem for transformer designers and manufacturers. When exposed to air, cellulose absorbs moisture from the air quite rapidly. If not immediately impregnated with oil, equilibrium with the moisture content of the air is reached in a relatively short time. The moisture absorption process is considerably slowed after the cellulose has been oil impregnated.

After being saturated with oil in the transformer, the cellulosic insulation is further exposed to moisture in the oil and will continue to absorb available moisture. This is partly due to the absorption of water from the surrounding air into the oil. This resulting further moisture absorption causes problems in the cellulosic insulation, increasing aging rate and degrading electrical qualities. Cellulose has a strong affinity for water (hygroscopic) and thus will not share the moisture equally with the insulating liquid. The hygroscopic nature of cellulose insulation constitutes an ever present difficulty both in the manufacture and maintenance of transformers which are so insulated.

The presence of moisture increases the aging rate of cellulosic insulation. Insulating paper with a one percent moisture content ages about six times faster than one with only 0.3 percent. Consequently, people have been trying for decades without success to substantially reduce these objectionable changes due to the presence of moisture in the solid insulation. Further, as cellulose ages, the chains of glucose rings in the molecules break up and release carbon monoxide, carbon dioxide, and water. The water attaches to impurities in the oil and reduces oil quality, especially dielectric strength. Small amounts of moisture, even microscopic amounts, accelerate deterioration of cellulose insulation. Studies show more rapid degradation in the strength of cellulose with increasing amounts of moisture even in the absence of oxidation.

Shrinkage

Cellulosic transformer material has to be processed under heat and vacuum to remove the moisture before oil impregnation. Cellulosic material shrinks when moisture is removed. It also compresses when subjected to pressure. Therefore, it is necessary to dry and pre-compress the cellulosic insulation to dimensionally stabilize windings before adjusting them to the desired size during the transformer assembly process.

Thermal Conductivity

Existence of localized hot regions (HST or Hot Spot Temperature) in the transformer due to thermal insulating properties of electrical insulation would cause thermal runaway around these regions if not for the overall system conductivity drawing excess heat away. HSTs must be adequately dissipated to prevent excessive heat accumulation, which could damage the transformer. Inordinate localized temperature rise causes rapid thermal degradation of insulation and subsequent electrical breakdown.

Chemical Stability

Oxidation can be controlled but not eliminated. Oxygen comes from the atmosphere or is liberated from the cellulose as a result of heat. Oxidation of the cellulose is accelerated by the presence of certain oil decay products called polar compounds, such as acids, peroxides and water. The first decay products, peroxides and water soluble and highly volatile acids, are immediately adsorbed by the cellulose insulation up to its saturation level. In the presence of oxygen and water, these "seeds of destruction" give a potent destructive effect on the cellulosic structure. The acids of low molecular weight are most intensively adsorbed by the cellulosic insulation in the initial period, and later, the rate of this process slows down. The oxidation reaction may attack the cellulose molecule in one or more of its molecular linkages. The end result of such chemical change is the development of more polar groups and the formation of still more water. The most common form of oxidation contamination introduces acid groups into the solid or liquid insulation. The acids brought on by oxidation split the polymer chains (small molecules bonded together) in the cellulosic insulation, resulting in a decrease of tensile strength. Oxidation also embrittles cellulosic insulation.

Thermal Degradation

A significant percent of cellulosic deterioration is thermal in origin. Elevated temperature accelerates aging, causing reduction in the mechanical and dielectric strength. Secondary effects include paper decomposition (DP or depolymerization), and production of water, acidic materials, and gases. If any water remains where it is generated, it further accelerates the aging process. Heating results in severing of the linkage bonds within the cellulose (glucose) molecules, resulting in breaking down of the molecules, causing the formation of water. This resulting water causes continuous new molecular fission, and weakens the hydrogen bonds of the molecular chains of pulp fibers.

Reduced Winding Compactness

Transformer heat additionally creates two problems: a) embrittlement of cellulosic material; and b) shrinkage of cellulose. The shrinkage results in a loose transformer structure which is free to move under impulse, or through fault, and which structure is more likely to result in damage to the insulation due to the embrittlement.

Withstanding Bending Forces of Conductor Insulation

A current use of cellulosic papers, with a 15-20% machine direction elongation results in conductor insulation which is less damaged by bending or twisting in coil manufacture. The current papers however have a cross directional elongation of less than 5%. These elongation characteristics of cellulosic materials present limitations for the transformer manufacturer in optimizing insulated wire bends and may not permit use of this material as a linear applied insulation.

It would be desirable to have an improved electrical insulating material that overcomes the above short comings of the presently used cellulosic electrical insulation. It would be desirable to have an insulation material that is not adversely affected by moisture and that does not require drying as an initial manufacturing step.

SUMMARY OF THE DISCLOSURE

According to an aspect of the present invention, a transformer assembly is provided that includes a housing, transformer oil disposed within the housing, a plurality of coils of electrically conductive wire disposed in the housing and in contact with the transformer oil, and aliphatic polyamide insulation material operable to insulate the coils disposed within the oil. The aliphatic polyamide insulation material includes stabilizing compounds and nano-fillers. The stabilizing compounds provide thermal and chemical stability for the insulation material.

According to another aspect of the present invention, a magnet wire is provided that includes an electrically conductive core and an aliphatic polyamide insulation material encasing the core. The aliphatic polyamide insulation material includes stabilizing compounds and nano-fillers. The stabilizing materials provide thermal and chemical stability for the insulation material.

According to another aspect of the present invention, a composition is provided that consists essentially of: a) 0.1% to about 10.0% by weight of stabilizing compounds that provide thermal and chemical stability; b) 0.1% to about 10.0% by weight of nano-fillers; and c) a remainder by weight of aliphatic polyamide.

Features and advantages of the present invention will become more apparent from the following detailed description of exemplary embodiments thereof, as illustrated in the accompanying drawings.

The present invention will be more readily understood from the following detailed description of preferred embodiments thereof.

DETAILED DESCRIPTION

Figure 1:
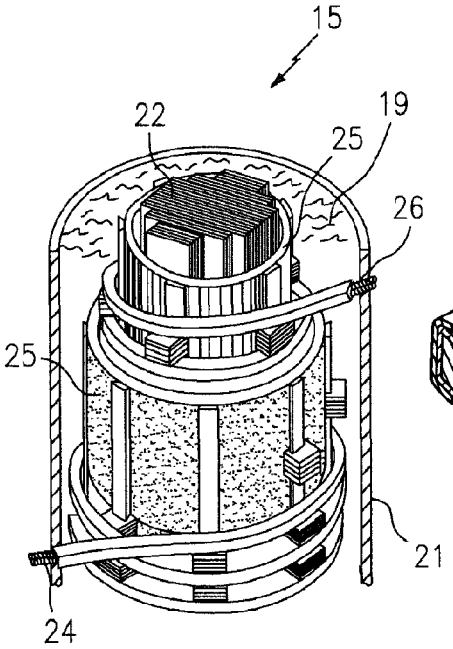
FIG. 1 is a fragmented diagrammatic perspective view of a transformer which is formed in accordance with this invention.
Figure 2:
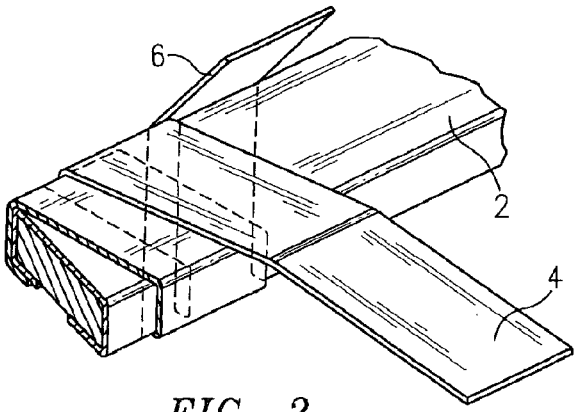
FIG. 2 is a fragmented perspective view of a spiral wrapped electrical magnet wire which is formed in accordance with this invention and which is used in the windings of an oil filled transformer.
Figure 3:
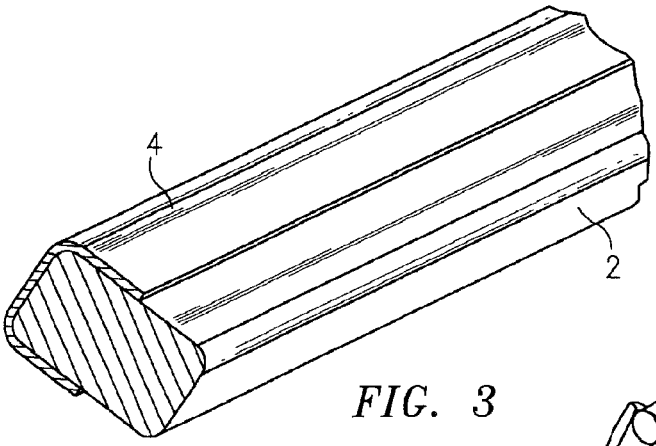
FIG. 3 is a perspective view similar to FIG. 1/2, but showing an electrical magnet wire having an axially insulation material which is formed in accordance with this invention and which is used in the windings of an oil filled transformer.

FIG. 1 is a fragmented diagrammatic perspective view of a transformer assembly 15. The transformer assembly 15 includes a housing 21, a core component 22, a low voltage winding coil 26, a high voltage winding coil 24, and oil 19 disposed within the housing. The coils 24, 26 are formed from magnet wire 2 encased in an aliphatic polyamide insulation material that will be described hereinafter (e.g., as shown in FIGS. 2 and 3). In some embodiments, the transformer assembly 15 includes insulation tubes 25 disposed between the core 22 and the low voltage winding coil 26, and between the low voltage winding coil 26 and the high voltage winding coil 24. These insulation tubes 25 are formed from the aliphatic polyamide insulation material of this invention. Depending upon the transformer configuration, the present aliphatic polyamide insulation material may be disposed elsewhere within the transformer assembly 15. The transformer assembly 15 shown in FIG. 1 is an example of a transformer assembly, and the present invention is not limited to this particular configuration.

The present aliphatic polyamide insulation material includes aliphatic polyamide, and/or one or more copolymers thereof, thermal and/or chemical stabilizers, and nano-fillers. The present aliphatic polyamide insulation material may be described as "consisting essentially of" the aliphatic polyamide (and/or one or more copolymers thereof), the thermal and/or chemical stabilizers, and the nano-fillers, since any other constituents that may be present within the insulation material do not materially affect the basic and novel characteristics of the present insulation material. The term "polyamide" describes a family of polymers which are characterized by the presence of amide groups. Many synthetic aliphatic polyamides are derived from monomers containing 6-12 carbon atoms; most prevalent are PA6 and PA66. The amide groups in the mostly semi-crystalline polyamides are capable of forming strong electrostatic forces between the —NH and the —CO— units (hydrogen bonds), producing high melting points, exceptional strength and stiffness, high barrier properties and excellent chemical resistance. Moreover, the amide units also form strong interactions with water, causing the polyamides to absorb water. These water molecules are inserted into the hydrogen bonds, loosening the intermolecular attracting forces and acting as a plasticizer, resulting in the exceptional toughness and elasticity. The percentage by weight of the aliphatic polyamide within the present insulation material is the balance of the insulation material other than thermal and/or chemical stabilizers, and the nano-fillers in the weight percentage ranges provided below.

Thermal and/or chemical stabilizers that can be used within the aliphatic polyamide insulation material include compounds, such as, but not limited to, copper halide, copper bromide, copper iodide, copper acetate, calcium bromide, lithium bromide, zinc bromide, magnesium bromide, potassium bromide and potassium iodide. These compounds provide significant thermal and chemical stability beyond the long term requirements of the current transformer designs, as will be pointed out in greater detail hereinafter. Selected mixtures of these additives are present in the present insulation material in a range of about 0.1 to about 10% by weight, and preferably about 2% by weight.

Acceptable nano-fillers that may be used within the present insulation material include, but not limited to, titanium dioxide ($TiO_2$), silicon dioxide ($SiO_2$—sometimes referred to as "fumed silica"), aluminum oxide ($Al_2O_3$—sometimes referred to as "Alumina"). The addition of the nano-fillers to the insulation material is believed to increase the dielectric strength, improve the electrical discharge resistance, improve the thermal conductivity, provide mechanical reinforcement, improve surface erosion resistance, and increase abrasion resistance. Nano-filler particles used within the insulation material are typically in the range of about 1 nm to about 100 nm in size. The nano-filler particles are typically present in the insulation material in a range of about 0.1% to about 10.0% by weight, and preferably in the range of about 2.0% to 4.0% by weight. During formation of the insulation material, the stabilizers and the nano-fillers are homogenously dispersed with the aliphatic polyamide material.

Figure 4:
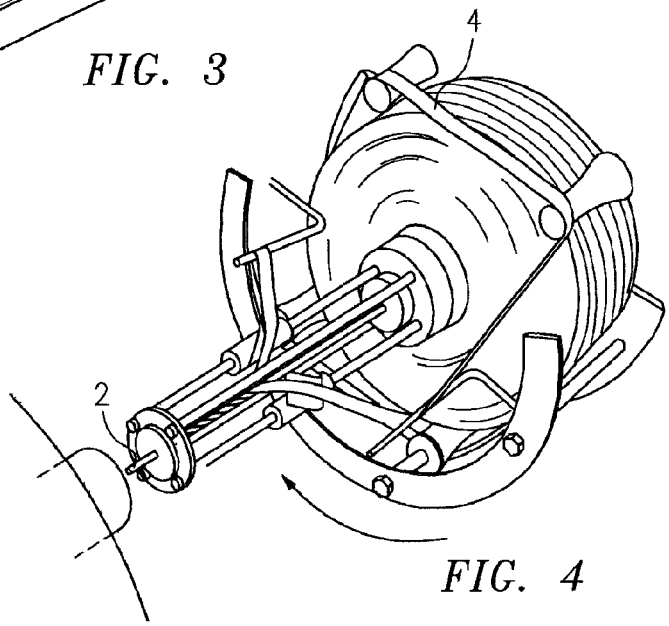
FIG. 4 illustrates a device for wrapping insulation material tape around a wire.

As described above and illustrated in the FIGS. 1-3, the present insulation material can be utilized in a variety of forms within an oil-filled transformer assembly 15 to produce significant benefits relative to prior art oil-filled transformer assemblies that utilize cellulosic insulation. For example, the present insulation material can be used to encase the magnet wires 2 that are used within the coils 24, 26 of the transformer assembly 15. FIGS. 2 and 3 show two different forms of insulated magnet wire 2; e.g., wires 2 insulated with aliphatic polyamide insulation material in tape form; e.g., tapes 4 and 6. FIGS. 2 and 4 show insulation material tapes 4 and 6 wrapped spirally around the circumference of the wire 2. FIG. 3, in contrast, shows an insulation material tape 4 wrapped around the wire 2, in a manner where the tape is applied in an axial direction. In FIG. 3, the insulation material tape 4 is shown around only a portion of the wire 2 to illustrate the orientation of the tape 4 relative to the wire 2. The tape form of the insulation material is an example of insulation material in a film. The term "tape" refers to a film embodiment wherein the length of the film is substantially greater than the width of the film, and the width of the film is typically substantially greater than the thickness of the film. In alternative film embodiments the length and width of the film may be such that film is more sheet-like.

Figure 5:
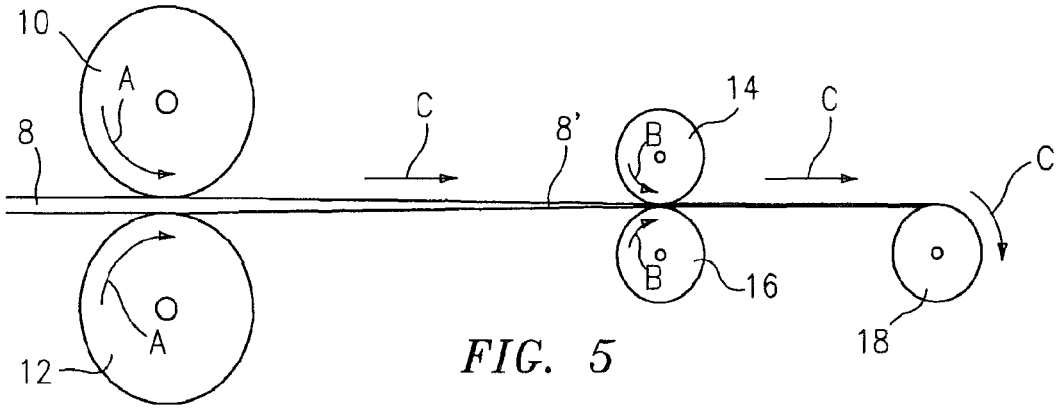
FIG. 5 is a schematic view of an assembly which is used to longitudinally stretch or elongate a film embodiment of the present aliphatic polyamide insulation material so as to induce crystallization of the film.

FIG. 5 is a schematic view of an assembly which can be used to axially elongate and stretch the insulation material when it is in the film form. The assembly includes a pair of heated rollers 10 and 12 through which the aliphatic polyamide insulation material film 8 is fed. The rollers 10 and 12 rotate in the direction A at a first predetermined speed and are operative to heat the film 8 and compress it. The heated and thinned film 8 is then fed through a second set of rollers 14 and 16 which rotate in the direction B at a second predetermined speed which is greater than the first predetermined speed, so as to stretch the film in the direction C to produce a thinner crystallized film 8 which is then fed in the direction C onto a pickup roller 8 where it is wound into a roll of the crystallized aliphatic polyamide insulation material film which can then be slit into insulation strips (i.e., tapes) if so desired.

In an alternative method, the magnet wires 2 may be coated (i.e., encased) with the insulation material by an extrusion process. The wire to be coated may be pulled at a constant rate through a crosshead die, where molten insulation material covers it.

Figure 6:
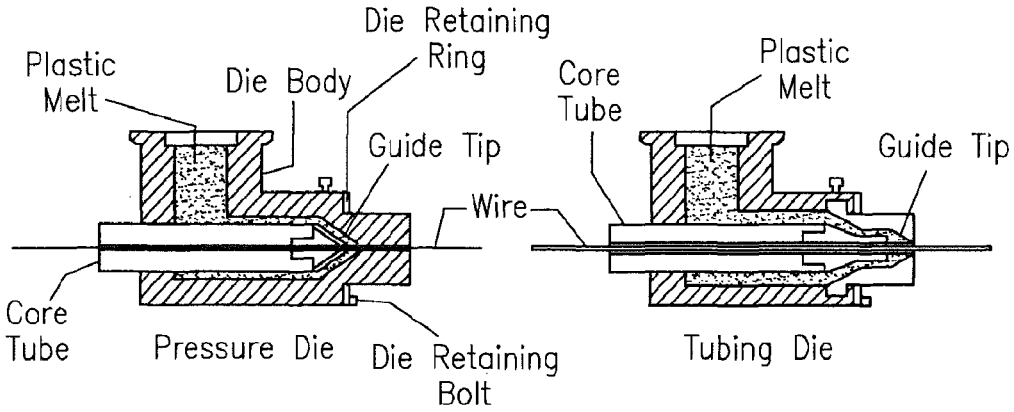
FIG. 6 is a schematic view showing the designs of a pressure die and tubing die used in wire coating operations.

FIG. 6 shows two examples of die designs that can be used in wire coating operations, although the present invention is not limited to these examples. The pressure die coats the wire inside the die, while the tubing die coats the wire core outside the die. The core tube, also referred to as the mandrel, is used to introduce the wire into the die while preventing resin from flowing backward where the wire is entering. Mandrel guide tip tolerances in a pressure die are approximately 0.001 inch (0.025 mm). This tight tolerance plus the forward wire movement prevents polymer backflow into the mandrel even at high die pressures. The guide tip is short, allowing contact of the polymer and the wire inside the die.

Figure 7:
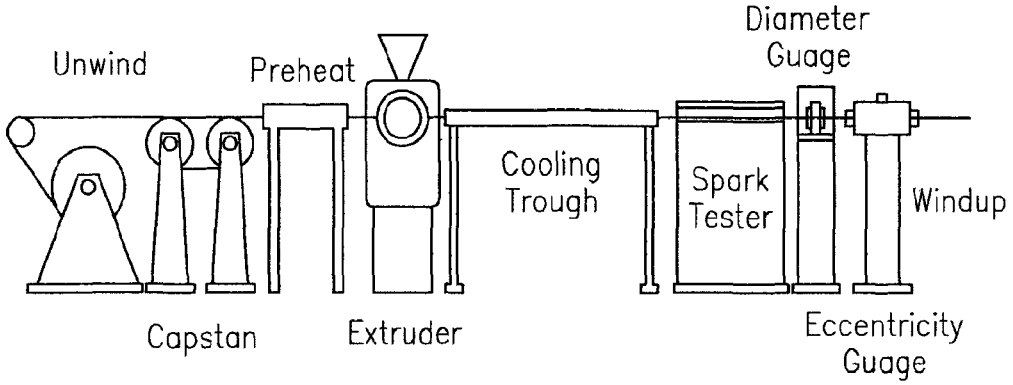
FIG. 7 is a ground view of the entire typical extrusion coating process.

FIG. 7 is a ground level view of a crosshead extrusion operation with typical equipment in the line. Typical pieces that can be used in each line include: a) an unwind station or other wire or cable source to feed the line; b) a pretensioning station to set the tension throughout the process; c) a preheat station to prepare the wire for coating; d) a crosshead die; e) a cooling trough to solidify the insulation material coating; f) a test station to assure the wire is properly coated; g) a puller to provide constant tension through the process; and h) a winder to collect the wire coated with insulation material. The wire passes through a pre-heater prior to the die to bring the wire up to the temperature of the polymer used to coat the wire. Heating the wire improves the adhesion between the wire and the insulation material and expands the wire, thereby reducing any shrinkage difference that may occur between the wire and the coating during cooling. The insulation material coating will likely shrink more than the wire, because the insulation material's coefficient of thermal expansion is typically greater than that for most conductive metals. Another advantage of pre-heating the wire is to help maintain the die temperature during normal operations. Cold wire passing through a die at high speed can be a tremendous heat sink. Finally, pre-heating can be used to remove any moisture or other contaminants (such as lubricants left on the wire from a wire drawing operation) from the wire surface that might interfere with adhesion to the plastic coating. Pre-heaters are normally either gas or electrical resistance heat and are designed to heat the wire to the melt temperature of the plastic being applied to the wire or just slightly below the melt temperature.

A crosshead extrusion operation has the extruder set at a right angle to the wire reel and the rest of the downstream equipment. Wire enters the die at a 90° angle to the extruder, with the polymer entering the side of the die and exiting at a 90° angle from the extruder. The present invention is not limited to formation within a crosshead extrusion die. After exiting the die, the polymer coating is cooled in a water trough, where the water is applied uniformly on all sides of the wire coating to prevent differences in resin shrinkage around the wire. After cooling, the wire can be passed through on-line gauges for quality control. Three different gauges are normally used to measure the wire for diameter, eccentricity, and spark. The diameter gauge measures the wire diameter. If the diameter is too large, the puller may be sped up or the extruder screw may be slowed. If the diameter is too small, the opposite of the described steps may be performed. The eccentricity gauge measures the coating uniformity around the wire. It is desirable to have uniform insulation material wall thickness around the circumference of the wire. The concentricity can be adjusted by centering the guide tip with the adjusting bolts. Finally, the spark tester checks for pinholes in the coating that can cause electrical shorts or carbon deposits in the polymer that can cause electrical conductivity through the coating. The three gauges may be installed in any order on the line. A capstan, caterpillar-type puller, or other pulling device is installed to provide constant line speed and tension during processing. A capstan is normally used with small diameter wire, where the wire is wound around a large diameter reel run at constant speed numerous times to provide a uniform pulling speed. A caterpillar-type puller with belts is used with large diameter wire. Sufficient pressure has to be applied to prevent the wire from slipping, providing uniform speed to the winder. Typically, two center winders are required in a continuous operation, with one winding up the product while the second waits in reserve for the first spool to be completed. Once the first spool is complete, the wire is transferred to the second spool as the first one is being emptied and prepared for the next.

A fibrous form of the insulating material can be formed in the following manner. The enhanced stabilized molten polymer resin is extruded through spinnerettes in a plurality of threads onto a moving support sheet whereupon the threads become entangled on the support sheet to form spunbonded sheets of the extruded material. These spunbonded sheets of insulation material are then compressed into sheets of insulation. Preferably, the sheets are then further processed by placing a plurality of them one top of one another and then they are once again passed through rollers which further compress and bond them so as to form the final sheets of the aliphatic polyamide insulating material in a fibrous form.

In order to enhance the insulation factor of the insulation of this invention, the fibrous embodiment of the insulation of this invention may be bonded to the film embodiment of the insulation of this invention to form a compound embodiment of an insulating material formed in accordance with this invention.

As indicated above, the present transformer assembly 15 may utilize the insulation material in a form other than a tape or other form (e.g., extruded coating) for covering the wires 2 within a coil 24, 26. In those embodiments where the insulation material is in a tube form or a sheet form (e.g., to insulate between coils, or between a coil and a grounded structure of the housing), the insulation material may be formed by an extrusion process and/or a roll forming process (e.g., a calendaring process). The present invention is not limited to insulation material in any particular form, or any process for making such form.

A variety of different transformer oils 19 can be used within the transformer assembly 15. For example, a mineral oil-type transformer oil (e.g., 76 Transformer Oil marketed by Conoco Lubricants), or a silicon-type transformer oil (e.g., 561 Silicone Transformer Liquid marketed by Dow Corning Corporation), or a natural ester-type transformer oil (e.g., Envirotemp FR3 marketed by Cooper Power Systems), or a high molecular weight hydrocarbon (HMWH) type transformer oil (e.g., R-Temp marketed by Cooper Power Systems). These transformer oils 19 are examples of acceptable oils, and the present invention is not limited thereto.

It will be readily appreciated that the aliphatic polyamide electrical insulating material of this invention will improve and stabilize oil filled transformers markedly. The insulating material of this invention clearly outperforms the current cellulose transformer insulating material in every important property. Examples of how the present insulation material provides beneficial performance are described hereinafter.

Moisture

The present insulation material, upon exposure to moisture, shows an increase in toughness and elongation. Long term exposure to moisture produces no appreciable negative aging effects. The subject material will absorb moisture, removing it from the surrounding oil 19, which may be a positive effect.

Shrinkage and Reduced Winding Compactness

As the subject material does not need to be dried before use, it does not have the initial shrinkage issues of the current cellulosic insulation materials. In addition, exposure to elevated transformer temperatures and moisture will not cause embrittlement as is the case with cellulosic materials. The transformer will not be subject to appreciable reduced winding compactness and problems associated therewith. Additionally, due to the high tensile strength and elongation memory of the subject material, turn insulation will remain tightly wrapped to the conductor wire. The stress-induced crystallinity of the film (longitudinally extended sheet) embodiment of the invention also provides improved long term dimensional stability.

Thermal Conductivity

The subject material film embodiment of the invention has a K factor (standard of thermal conductance=W/m–K) of 0.25. Oil impregnated cellulosic material has a K factor of approximately 0.10 (based on 20% oil saturation). Further, the subject material has a dielectric strength approximately twice (2×) that of oil impregnated cellulosic insulation of equal thickness, requiring approximately half the thickness in turn insulation for the same electrical insulation characteristics. This would yield a minimum of four times (4×) improvement in turn-to-turn thermal conductivity, a significant improvement in overall system conductivity. Use of the film embodiment of this invention will result in reduced requirements for designing for the "worst case" thermal stress of insulating paper in the hot spot of winding during the overload condition.

Thermal Degradation and Oxidative Stability

The present aliphatic polyamide insulating material contains one or more thermal and/or chemical stabilizers as described above. These compounds provide significant thermal and chemical stability beyond the long term requirements of the current transformer designs. The inclusion of these compounds within the present insulation material may permit transformers to operate at higher temperatures and have a longer operating life than the current transformers utilizing cellulosic insulation.

Withstanding Bending Forces of Conductor Insulation

The present aliphatic polyamide film insulation material, if manufactured with stress induced crystallinity in the machine direction, has mechanical properties that are ideal for turn (conductor) insulation; e.g., very high machine direction tensile strength, high machine direction elongation with elastic memory, and a very high level of cross directional elongation (over 100%) which provides more versatility to the linear and spiral wrap types of insulation. These properties facilitate very high speed insulation material wrapping on a magnet wire that will remain tight regardless of subsequent bending or twisting. The film version of the insulation material may be subject to stress induced crystallinity in the machine direction by stretching and elongating sheets of the aliphatic polymer film complex.

The subject tensile strength, elongation, thermal conductivity, and heat transfer coefficient characteristics of the aliphatic polyamide insulation material of this invention and cellulose insulation material were compared with the following observed results:

| Properties | Method | Unit | Present Insulation (1.5 mil Thickness) | Prior Art Cellulosic Insulation (3.1 mil Thickness) |
|---|---|---|---|---|
| Tensile Strength (MD) | | | | |
| initial processing in oil; ASTM D-2413 ▲ | TAPPI | lbs/in | 48.3 | 47.3 |
| In Oil (no aging - control) | T494 | | 54.1 | 54.8 |
| In Oil (after aging 29 Days @160° C.) ~20 yrs | | | 54.3 | 17.3 |
| In Oil (after aging 58 Days @160° C.) ~40 yrs | | | 57.9 | 12.2 |
| ▲ Aging Test per IEEE C57.100 - to pass the test after each cycle; the tensile value at the end of each cycle must be 50% of the initial value | | | | |
| Elongation (MD) | | | | |
| initial processing in oil; ASTM D-2413 | TAPPI | % | 21.0 | 20.0 |
| In Oil (no aging - control) | T494 | | 28.3 | 8.0 |
| In Oil (after aging 29 Days @160° C.) | | | 19.9 | 1.1 |
| In Oil (after aging 58 Days @160° C.) | | | | |
| Thermal Conductivity | | | | |
| In Oil (after aging 29 Days @160° C.) K Value (Celluosic Insul = 80% paper + 20% oil) | ASTM D5470 | W/(m-K) | 0.250 | 0.070 |
| Heat Transfer Coefficient = K/L (L is thickness) | | | | |
| In Oil (after aging 29 Days @160° C.) K Value (Celluosic Insul = 80% paper + 20% oil) | ASTM D5470 | $W \cdot K^{-1} \cdot m^{-2}$ | 0.167 | 0.023 |

It will be noted that the various properties of the present aliphatic polyamide insulation material far out perform the current day cellulose insulating material. In fact, the tensile strength of the present aliphatic polyamide insulation actually increases in the high temperature oil filled environment.

The tensile strength and elongation properties of the present aliphatic polyamide insulation material (referred to as "stabilized") and a 100% aliphatic polyamide insulation material (referred to as "unstabilized") were also compared after oven aging in air at 140° C. with the results shown in the following table.

| | Elongation as a % of the Original Value | | Tensile Strength as a % of the Original Value | |
|---|---|---|---|---|
| Exposure (Hrs) | Unstabilized PA 66 | Stabilized PA 66 | Unstabilized PA 66 | Stabilized PA 66 |
| 0 | 100 | 100 | 100 | 100 |
| 240 | 4 | 112 | 35 | 101 |
| 500 | 3 | 114 | 26 | 103 |
| 1,000 | 3 | 114 | 23 | 102 |
| 2,000 | 2 | 90 | 17 | 106 |

It will be noted that the elongation retention and the tensile strength retention properties of the present stabilized aliphatic polyamide insulation material far out performs the unstabilized aliphatic polyamide insulating material when subjected to high temperatures in air in an oven. As indicated above, the tensile strength of the polyamide insulation actually increases in the high temperature oven environment.

What is claimed is:

1. A transformer assembly, comprising:

a housing;

transformer oil disposed within the housing;

a plurality of coils of electrically conductive wire, disposed in the housing and in contact with the transformer oil; and an insulation material disposed within the assembly to electrically insulate the coils, which insulation material consists essentially of an aliphatic polyamide material, and stabilizing compounds that provide thermal and chemical stability for the insulation material, and nano-fillers sized within the range of about 1 nm to 100 nm.

2. The transformer assembly of claim 1, wherein the stabilizing compounds are selected from the group consisting of copper halide, copper bromide, copper iodide, copper acetate, calcium bromide, lithium bromide, zinc bromide, magnesium bromide, potassium bromide and potassium iodide and mixtures thereof.

3. The transformer assembly of claim 2, wherein the stabilizing compounds are present in an amount which is in the range of about 0.1% to about 10.0% by weight of the insulation material.

4. The transformer assembly of claim 1, wherein the nano-fillers are selected from the group consisting of titanium dioxide ($TiO_2$), silicon dioxide ($SiO_2$), and aluminum oxide ($Al_2O_3$), and mixtures thereof.

5. The transformer assembly of claim 1, wherein the insulation material includes nano-fillers in a range of about 0.1% to about 10.0% by weight.

6. The transformer assembly of claim 5, wherein the insulation material includes nano-fillers in a range of about 2.0% to about 4.0% by weight.

7. The transformer assembly of claim 1, wherein the insulation material insulating the coils includes one or more of insulation material surrounding individual wires within the coils, insulation material disposed between the coils, and insulation material disposed between one or more of the coils and electrically grounded structure within the housing.

8. The transformer assembly of claim 7, wherein the insulation material is formed by extrusion.

9. A transformer assembly having a housing operable to contain transformer oil, the assembly comprising:

a plurality of coils of electrically conductive wire, disposed in the housing and positioned to contact with transformer oil disposed within the housing; and an insulation material configured to electrically insulate the coils contacting the oil, which insulation material consists essentially of an aliphatic polyamide material, and stabilizing compounds that provide thermal and chemical stability for the insulation material, and nano-fillers sized within the range of about 1 nm to 100 nm.

10. A magnet wire, comprising:

an electrically conductive core; and an insulation material encasing the core, which insulation material consists essentially of an aliphatic polyamide material, and stabilizing compounds that provide thermal and chemical stability for the insulation material, and nano-fillers sized within the range of about 1 nm to 100 nm.

11. The magnet wire of claim 10, wherein the stabilizing compounds are selected from the group consisting of copper halide, copper bromide, copper iodide, copper acetate, calcium bromide, lithium bromide, zinc bromide, magnesium bromide, potassium bromide and potassium iodide and mixtures thereof.

12. The magnet wire of claim 11, wherein the stabilizing compounds are present in an amount which is in the range of about 0.1% to about 10.0% by weight of the insulation material.

13. The magnet wire of claim 10, wherein the nano-fillers are selected from the group consisting of titanium dioxide ($TiO_2$), silicon dioxide ($SiO_2$), and aluminum oxide ($Al_2O_3$), and mixtures thereof.

14. The magnet wire of claim 10, wherein the insulation material includes nano-fillers in a range of about 0.1% to about 10.0% by weight.

15. The magnet wire of claim 14, wherein the insulation material includes nano-fillers in a range of about 2.0% to about 4.0% by weight.

16. The transformer assembly of claim 7, wherein the insulation material surrounding the individual wires within the coils is a coating that encases respective individual wires.

17. The transformer assembly of claim 16, wherein the insulation material coating is an extruded coating.

* * * * *